US009003721B1

(12) United States Patent
Jensen

(10) Patent No.: US 9,003,721 B1
(45) Date of Patent: Apr. 14, 2015

(54) LEVELING ARRANGEMENT FOR A TOWER

(71) Applicant: Siemens Aktiengesellschaft, Munich (DE)

(72) Inventor: Martin Johan Smith Jensen, Børkop (DK)

(73) Assignee: Siemens Aktiengesellschaft (DE)

( * ) Notice: Subject to any disclaimer, the term of this patent is extended or adjusted under 35 U.S.C. 154(b) by 0 days.

(21) Appl. No.: 14/075,014

(22) Filed: Nov. 8, 2013

(51) Int. Cl.
*E04B 9/00* (2006.01)
*E02D 27/42* (2006.01)
*E04H 12/34* (2006.01)

(52) U.S. Cl.
CPC ..... *E02D 27/425* (2013.01); *E04H 12/34* (2013.01)

(58) Field of Classification Search
USPC ..... 52/126.6, 126.1, 292, 294
See application file for complete search history.

(56) References Cited

U.S. PATENT DOCUMENTS

2008/0180349 A1* 7/2008 Newman ..... 343/890
2008/0232906 A1* 9/2008 Henderson ..... 405/233
2012/0057979 A1* 3/2012 Schellstede ..... 416/169 R
2012/0308307 A1* 12/2012 Del Campo Y Ruiz De Almodovar ..... 405/196
2013/0008097 A1* 1/2013 Margevicius et al. ..... 52/123.1
2013/0255169 A1* 10/2013 Henderson ..... 52/223.13
2014/0184468 A1* 7/2014 Fitch et al. ..... 343/872

FOREIGN PATENT DOCUMENTS

EP 0173553 B1 4/1990
EP 2636899 A1 9/2013

OTHER PUBLICATIONS

European Search Report for European Application No. 14181648.8, mailed on Dec. 2, 2014.

* cited by examiner

*Primary Examiner* — Mark Wendell
(74) *Attorney, Agent, or Firm* — Schmeiser, Olsen & Watts LLP

(57) ABSTRACT

Provided is a leveling arrangement for a tower, which leveling arrangement comprises a leveling ring realized for placement between a tower foundation and the tower; and a leveling apparatus, which leveling apparatus comprises a connection means for detachably connecting the leveling apparatus to the leveling ring during a leveling procedure; and a number of adjustment legs, wherein an adjustment leg is realized to effect a displacement of the leveling ring relative to the tower foundation during the leveling procedure; along with a method of providing a level mounting interface for a tower; and a method of erecting a wind turbine tower; and a wind turbine tower assembly.

14 Claims, 7 Drawing Sheets

LEVELING ARRANGEMENT FOR A TOWER

TECHNICAL FIELD

The invention describes a leveling arrangement for a tower; a method of providing a level mounting interface for a tower; a method of erecting a wind turbine tower; and a wind turbine tower assembly.

BACKGROUND

A tower such as a wind turbine tower must be secured to a foundation in some way. In the case of a concrete foundation, for example, the lower section of a wind turbine tower is usually anchored to the foundation using anchor bolts that were previously embedded in the concrete. The "heads" of the anchor bolts are usually fixed in steel anchor plates that were laid horizontally in the foundation and covered with a suitably thick layer of concrete, so that most of each anchor bolt is embedded and only a relatively short section of each anchor bolt remains protruding vertically upward from the surface of the foundation.

However, it is very difficult to achieve a perfectly horizontal upper surface of foundation. At the same time, it is necessary to ensure that a lower tower section is placed horizontally, otherwise the resulting unbalanced loading would stress the tower structure and may lead to irreparable damage. In some known approaches, a horizontal alignment is achieved by first estimating where a height adjustment might be necessary, placing shims over the appropriate anchor bolt ends, and repeating the process until the corrections are deemed sufficient. The tower flange of the lowest tower section can then be lowered into place over the "corrected" anchor bolt ends. If the correction was performed properly, the lower surface of the tower flange will lie in the desired horizontal plane. However, such a procedure is very time-consuming, since great effort must be invested to determine what corrections are necessary and whether the corrections are sufficient before putting the lowest tower section into place.

In another approach, a leveling ring can be used as an intermediate layer between the foundation and the tower flange. Such a leveling ring is arranged to fit over the anchor bolts, and grout is pushed under the leveling ring in various places until an upper surface of the leveling ring is essentially horizontal. Once the grout has hardened, the bottom tower section is lowered into place over the anchor bolts and these are secured. However, this approach is also difficult to get right, since it is not easy to achieve a perfectly horizontal alignment of the leveling ring. This is because a tower can have a very large lower diameter, depending on the generating capacity of the wind turbine, and a leveling ring must be at least as wide. The diameter at the tower base can be in the range of 3.0 to 6.0 meters, for example about 4.0 meters for a 3 Megawatt wind turbine. Since a leveling ring must also be made of a strong material such as steel, it is a very heavy component and therefore difficult to manipulate, particularly when a very precise leveling adjustment must be made in the millimeter range. Thus a need exists to provide an improved way of providing a horizontal mounting surface for a wind turbine tower.

SUMMARY

A first aspect is achieved by a leveling arrangement. a second aspect is achieved by a method of providing a level mounting surface for a tower. A third aspect is achieve by a method of erecting a wind turbine tower. A fourth aspect is achieved by a wind turbine tower assembly.

A leveling arrangement for a tower may comprise a leveling ring realized for placement between a tower foundation and the tower; and a leveling apparatus, which leveling apparatus may comprise a connection means for detachably connecting to the leveling ring during a leveling procedure, and a number of adjustment legs, wherein an adjustment leg is realized to effect a displacement of the leveling ring relative to the tower foundation during the leveling procedure.

An advantage of the leveling arrangement is that the adjustment legs of the leveling apparatus can be used to achieve a very precise horizontal alignment of the leveling ring, which in turn will present an essentially horizontal connection surface for a tower. The alignment of the leveling ring can be performed in a very simple and straightforward manner.

A method of providing a level mounting interface for a tower may comprise the steps of detachably connecting a leveling ring to a leveling apparatus; arranging the leveling apparatus over a tower foundation; operating the leveling apparatus to effect a displacement of the leveling ring relative to the tower foundation until the leveling ring presents a level mounting surface; bonding the leveling ring to the tower foundation; and disconnecting and removing the leveling apparatus from the leveling ring.

An advantage of the method of providing a level mounting surface is that an essentially horizontal connection surface for a tower can be achieved in a quick and accurate manner. Furthermore, the leveling apparatus can be quickly and easily connected to the leveling ring, and just as easily disconnected from the leveling ring again once this is secured on the foundation.

A method of erecting a wind turbine tower may comprise the steps of providing a level mounting interface for the wind turbine tower using the method of providing a level mounting interface that comprises a leveling ring that is connected to a tower foundation, and a plurality of connectors protruding through the leveling ring. The method may further comprise a step of connecting a lower tower flange of the wind turbine tower to the connectors of the level mounting interface.

An advantage of the method of erecting a wind turbine tower is that the steps are straightforward to carry out. Particularly the step of providing a level mounting interface can be carried out relatively quickly. The precisely leveled mounting interface then provides a safe and load-efficient basis to which the lower tower flange can be connected.

A wind turbine tower assembly may comprise a tower foundation; a leveling ring leveled using a leveling apparatus according to the invention and connected to the tower foundation; and a wind turbine tower comprising a lower tower flange bolted to the leveling ring.

An advantage of the wind turbine tower assembly is that the loads can be transferred safely and evenly into the tower foundation. Structural damage owing to uneven loading is effectively avoided, so that the lifetime of the tower can be favorably long, in contrast to a tower assembly erected on a foundation prepared using a prior art leveling procedure.

Particularly advantageous embodiments and features of the invention are given by the claims, as revealed in the following description. Features of different claim categories may be combined as appropriate to give further embodiments not described herein.

For the sake of clarity, it is to be understood that the use of "a" or "an" throughout this application does not exclude a plurality, and "comprising" does not exclude other steps or elements.

BRIEF DESCRIPTION

Other objects and features of the present invention will become apparent from the following detailed descriptions considered in conjunction with the accompanying drawings. It is to be understood, however, that the drawings are designed solely for the purposes of illustration and not as a definition of the limits of the invention.

In the diagrams, like numbers refer to like objects throughout. Objects in the diagrams are not necessarily drawn to scale.

DETAILED DESCRIPTION

Figure 1:
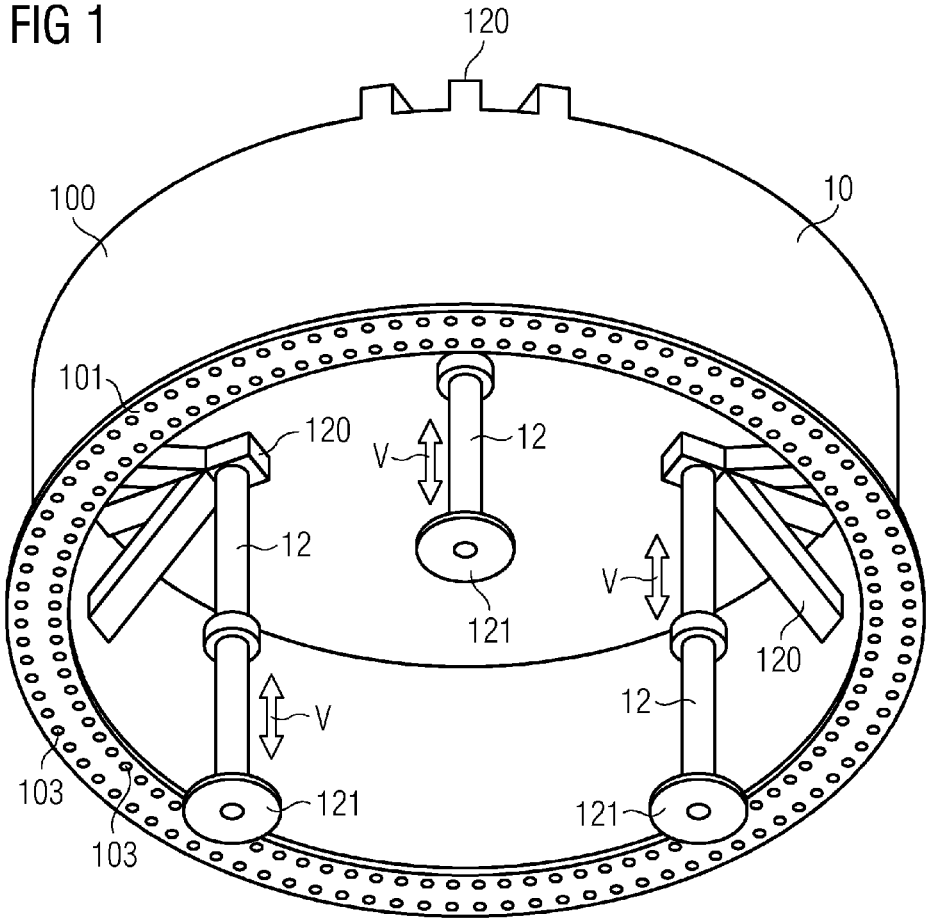
FIG. 1 shows a leveling apparatus of a first embodiment of a leveling arrangement according to the invention.

In the following, without restricting the invention in any way, it may be assumed that the tower is a wind turbine tower. Similarly, it may be assumed in the following that a foundation comprises a concrete foundation into which an annular arrangement of anchor bolts has been embedded using any suitable technique, for example by embedding anchor plates in the wet foundation and allowing this to harden. In the following, the expression "providing a level mounting interface for a tower" may be referred to more simply as a "leveling procedure". Also, the terms "leveling apparatus" and "leveling fixture" may be used interchangeably.

The "adjustment leg" can be realized in any suitable way. The function of the adjustment leg is to hold and simultaneously adjust the orientation of the leveling apparatus, so that the leveling ring can be aligned as desired. For example, a leveling apparatus can comprise one or more adjustment legs arranged at a distance outward from the future tower flange position, and some means of securing a leveling ring to these adjustment legs. For example, a suitable framework might be used as a leveling apparatus, with some means of securing the leveling ring during a leveling procedure, and some means of displacing the leveling ring relative to the tower foundation during the leveling procedure. In an embodiment of the invention, an adjustment leg comprises a foot for resting on the foundation and a gripper for gripping the leveling apparatus. For example, a single adjustment leg can be arranged essentially at the geometric center of the future tower flange position. Such a single adjustment leg can hold the leveling ring using a suitable construction that can also tilt in any direction to achieve the desired horizontal alignment.

In another embodiment of the invention, the leveling apparatus comprises three adjustment legs. Three fixed points can be used to define a horizontal plane, so that the use of three adjustment legs allows a favorably simple construction of the leveling apparatus. In an embodiment of the invention, an adjustment leg of the leveling apparatus comprises a height adjustment means for effecting the displacement of the leveling ring relative to the fixed point associated with that adjustment leg, and therefore also relative to the tower foundation. For example, when three adjustment legs (standing on three "feet" in a region bounded by the future tower flange) are used to hold the leveling ring, their height adjustment means can be used to obtain an essentially horizontal orientation of the leveling ring. By this is meant that an upper surface of the leveling ring, which will later connect to a lower surface of a tower flange, is essentially horizontal.

A visual inspection or assessment of the quality of the horizontal alignment may be made by one or more operators observing and controlling the leveling arrangement. Vertical displacements of the adjustment legs can be made manually, for example by using a controller to actuate a hydraulic piston of an adjustment leg. However, in an embodiment of the invention, the leveling arrangement may comprise an offset detector for detecting an offset between an actual position of the leveling ring and a desired position of the leveling ring. An offset detector may be used to determine any offset between the leveling ring and the horizontal plane in which the lower tower flange should lie. Such an offset detector can issue appropriate information to controllers of the adjustment legs to effect the desired displacements. For example, at a point corresponding to an adjustment leg, the leveling ring may be deemed to be too far away from the foundation, so that the leveling ring must be lowered by that adjustment leg by a certain offset. Equally, at a point corresponding to an adjustment leg, the leveling ring may be deemed to be too close to the foundation, so that it must be raised by an offset. Of course, the leveling ring may be deemed to have a satisfactory distance to the foundation at a point corresponding to an adjustment leg, so that a vertical displacement of the leveling ring is not required by that adjustment leg.

The connection means between the adjustment legs and the leveling ring can be made in any suitable manner, for example by using an appropriate framework as indicated above. However, in an embodiment of the invention, the leveling apparatus comprises a cylindrical body. This cylindrical body may have a diameter that is similar to the diameter of the leveling ring and the tower flange. In a further embodiment of the invention, the connection means of the leveling apparatus for detachably connecting to the leveling ring comprises an annular arrangement of through-holes. To this end, the connection means may comprise a flange or similar element in which the through-holes could be formed. The leveling ring may also have an essentially identical annular arrangement of bores or through-holes, i.e. the same number of through-holes with the same spacing and the same bore. This allows the leveling ring to be connected to the cylindrical body of the connection means simply by using standard nut-and-bolt fasteners.

Another advantage of using such a cylindrical body is that a lower tower section of the same type that will be used in the future tower could be used directly as the connection means. A lower tower section generally already has a cylindrical body and a flange with an annular arrangement of through-holes.

A significant advantage of using a cylindrical body as connection means is that the leveling ring can comprise a plurality of leveling ring segments. In other words, the leveling arrangement according to the invention makes it easy to use a segmented leveling ring, with all its transport and weight-associated advantages. The leveling ring segments can be realized to abut each other, or their outer or "short" ends can be made to fit together in a stepped joint, a tongue-and-groove joint, or any other appropriate joint.

In an embodiment of the invention, the step of bonding the leveling ring to the tower foundation comprises the step of filling any spaces between leveling ring and tower foundation with a grout layer. To this end, once the leveling ring has been aligned in the desired horizontal plane, any remaining spaces or gaps between the leveling ring and the upper surface of the foundation may be filled with grout, since this is a malleable material and can be pressed into essentially any gap, and when hardened, the resulting "grout bed" can act to effectively transfer loads from the tower and into the foundation. Since the leveling ring itself offers a relatively large surface area, and since the grout can be spread over the entire area under the leveling ring, the arrangement according to the invention favorably allows the use of a low-strength grout. This can present a significant advantage in a country in which the use of high-strength grout is not approved in a wind turbine tower foundation. In such countries, when using the known methods for erecting a wind turbine tower, it has been necessary to make the lower tower flange quite wide in order for the structural loads to be safely transferred into the foundation by the low-strength grout. However, a wide tower flange is associated with transport difficulties and considerable expense, as will be known to the skilled person. The leveling arrangement according to the invention allows a low-strength grout to be used, while at the same time allowing the tower flange width to be kept favorably narrow. Furthermore, since the leveling ring can be provided in segments, transportation problems do not arise.

In another embodiment of the invention, the annular arrangement of through-holes in the connection means (and leveling ring) corresponds to a tower flange annular through-hole arrangement. The advantage of such a realization is that the bolts that will be used to connect the leveling ring to the tower flange may initially be used to connect the leveling ring to the leveling apparatus, and can then remain in position after the leveling apparatus has been disconnected from the leveling ring, after the leveling procedure has been carried out. The bolts may be placed such that the bolt head is "underneath" the leveling ring, and the threaded bolt body extends vertically upward through the leveling ring. After the leveling procedure and removal of the leveling apparatus, the leveling ring remains on the grout bed, with an annular ring of bolts extending vertically upward in readiness to receive the tower flange.

As explained above, a wind turbine tower is usually anchored to the foundation using anchor bolts that are embedded in the concrete foundation. The "heads" of the anchor bolts are usually fixed in steel anchor plates that are laid horizontally in the foundation and covered with concrete, so that most of each anchor bolt is embedded, and only a portion of each anchor bolt protrudes vertically upward from the foundation. In the common solutions, a horizontal alignment of the tower flange is achieved using shims placed over the anchor bolt ends, and the tower flange of the lowest tower section is put into place over the anchor bolt ends. In an embodiment of the invention, the step of arranging the leveling apparatus over the tower foundation comprises mating the leveling ring with anchor bolt connectors protruding from the tower foundation. To this end, in addition to the annular arrangement of through-holes that will mate with the through-holes of the tower flange, the leveling ring has an additional annular arrangement of through-holes for the anchor bolts. To this end, when two rings of anchor bolts are to be used, these may be arranged in an outer annular arrangement and an inner annular arrangement, whereby the diameter of the outer annular arrangement is larger than its prior art counterpart, and the diameter of the inner annular arrangement is smaller than its prior art counterpart.

FIG. 1 shows a leveling apparatus 10 of a first embodiment of a leveling arrangement according to the invention, in a view from below or underneath. The leveling apparatus 10 comprises an essentially cylindrical body 100 with a diameter that is similar to the diameter of a lower tower segment for which the leveling arrangement is to be used to provide a level mounting interface. The leveling apparatus 10 comprises a lower flange 101 to which a leveling ring 2 will later be connected. The lower flange 101 shows two annular rings of through-holes 103. These correspond to one or more annular rings of through-holes in the leveling ring, and also to one or more annular rings of through-holes of the tower flange, as will become clear in the following. The leveling apparatus 10 also comprises three adjustment legs 12 that are used to bring the lower flange 101 (and therefore also the leveling ring) into a horizontal plane, so that a horizontally level mounting interface can be obtained in a quick and straightforward manner for a tower such as a wind turbine tower. Each adjustment leg 12 has a relatively wide "foot" 121 that rests on the ground. Furthermore, each adjustment leg 12 is firmly secured to the cylindrical body 100 of the leveling apparatus 10. In this embodiment, the leveling apparatus 10 comprises gripper elements 120 that connect the adjustment legs 12 to the cylindrical body 100. Each adjustment leg 12 is realized to be extendable in a vertical direction, as indicated by the vertical arrow V. Each leg 12 can be independently actuated, so that even if the feet 121 are positioned in a plane that is not horizontal, the flange 101 (and therefore also the leveling ring) can be brought into a horizontal plane.

Figure 2:
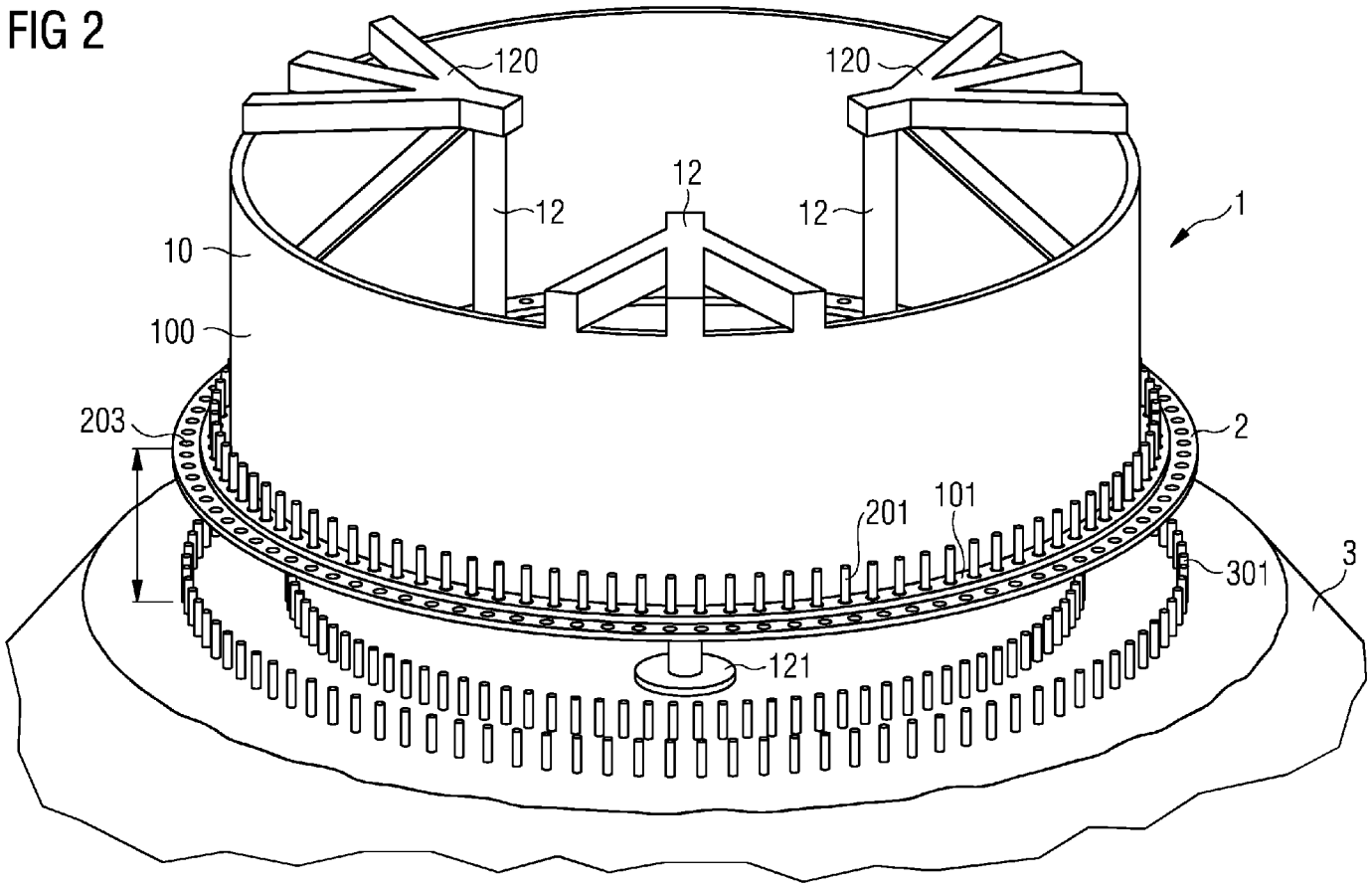
FIG. 2 shows the leveling arrangement of FIG. 1 in place over a tower foundation in an initial stage of a leveling procedure.

FIG. 2 shows a leveling arrangement 1 with the leveling apparatus 10 of FIG. 1 in place over a tower foundation 3 in an initial stage of a leveling procedure. Here, the feet 121 of the adjustment legs 12 are resting on the upper surface of the foundation 3 in a region corresponding to the interior of the tower that is to be erected on the foundation 3. The diagram shows a leveling ring 2 connected to the lower flange 101 by means of ring bolts 201. In a previous foundation preparation procedure, anchor bolts 301 have been embedded in the foundation 3 such that a portion of each anchor bolt 301 extends vertically upward through the foundation surface. The anchor bolts 301 are arranged in an annular ring formation corresponding to an annular arrangement of through-holes 203 in the leveling ring 2. In a first stage, the adjustment legs 12 of the leveling apparatus 10 are extended so that the lower flange 101 and leveling ring 2 are at a distance above the foundation.

Figure 3:
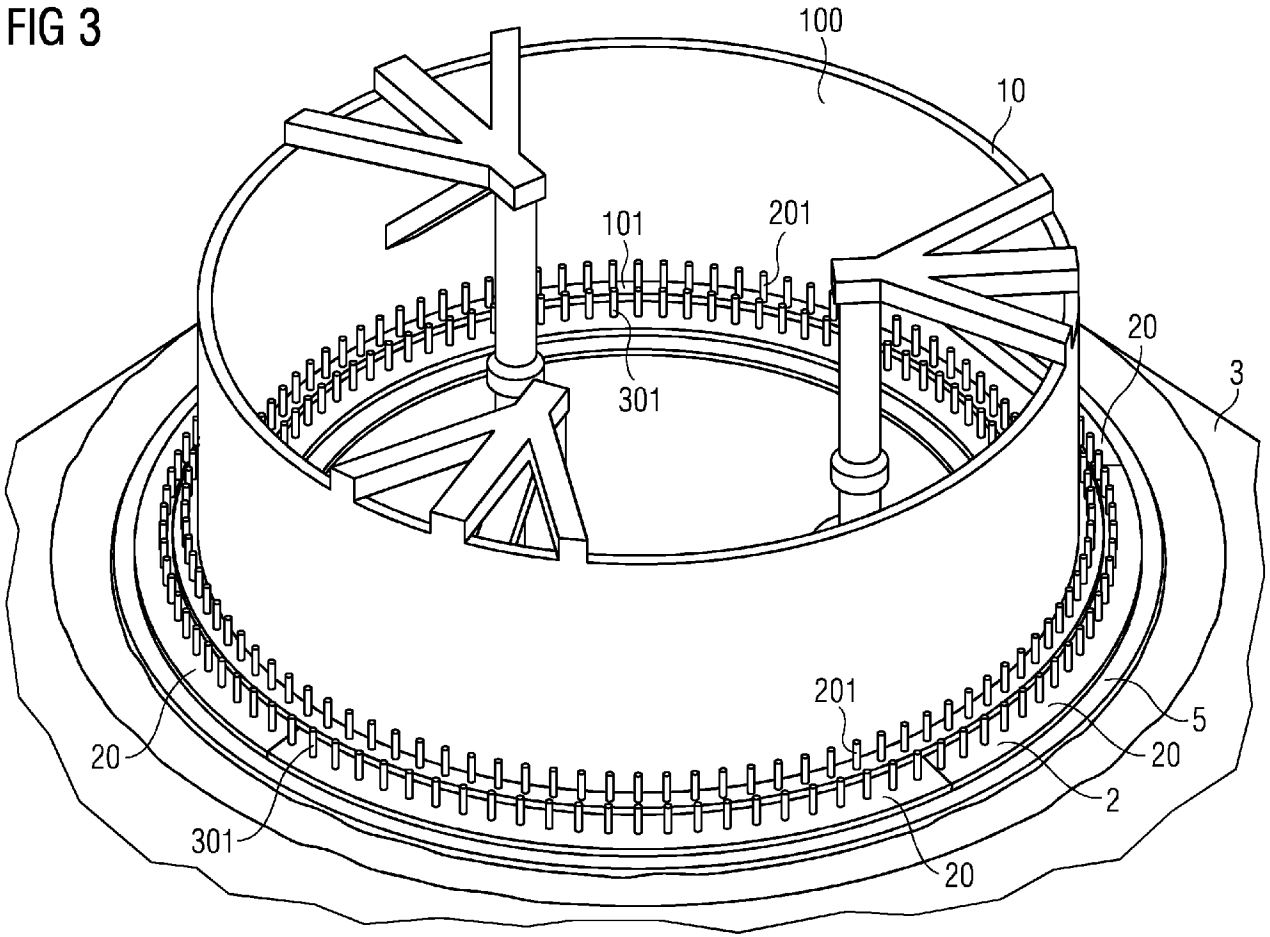
FIG. 3 shows the leveling arrangement of FIG. 1 in a subsequent stage of the leveling procedure.
Figure 4:
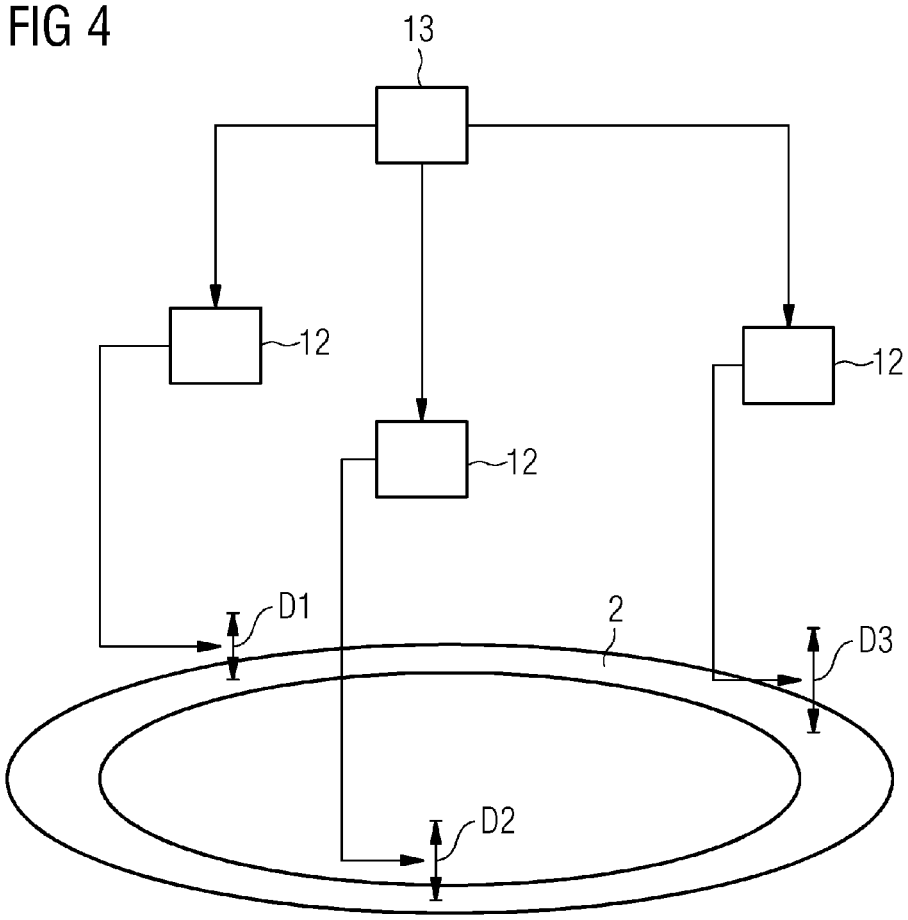
FIG. 4 illustrates the principle of operation of the leveling arrangement according to the invention.

FIG. 3 shows the leveling arrangement 1 of FIG. 1 in a subsequent stage of the leveling procedure. This diagram also shows that the leveling ring 2 can comprise a number of ring segments 20. Here, the adjustment legs 12 of the leveling apparatus 10 have been retracted so that the cylindrical body has 10 been lowered towards the foundation 3, and so that the anchor bolts 301 of the foundation 3 can pass through the through-holes 203 in the leveling ring 2. This can be regarded as a first rough alignment step. A precise leveling step follows, and is explained with the aid of FIG. 4, which illustrates the principle of operation of the leveling arrangement 1 according to the invention. The leveling ring 2, which is bolted to the lower flange 101 of the leveling apparatus 10, is brought into a horizontal plane by means of the adjustment legs 12. Since each of the legs 12 is independently adjustable, and since three points are sufficient to uniquely define a horizontal plane, the plane containing the leveling ring 2 can be made essentially perfectly horizontal by actuating the adjustment legs 12 independently to lift or lower the leveling ring 2 as required, as indicated by the three displacements D1, D2, D3. A visual assessment made by an operator of the leveling fixture 10 may be enough to determine by how much each adjustment leg 12 must be actuated to obtain the desired horizontal alignment. Alternatively, as indicated here, an offset sensor 13 may be used to determine any offset between the leveling ring 2 and a horizontal plane. The offset detector 13 can issue appropriate information to controllers of the adjustment legs 12 to effect the desired displacements D1, D2, D3. For example, the leveling ring 2 may be deemed to have a satisfactory distance D2 to the foundation 3 at a point corresponding to a first adjustment leg. At a point corresponding to a second adjustment leg, the leveling ring 2 may be deemed to be too far away from the foundation 3, so that it must be lowered by a certain offset. Similarly, at a point corresponding to the third adjustment leg, the leveling ring 2 may be deemed to be too close to the foundation 3, so that it must be raised by an offset.

Returning to FIG. 3, once the leveling ring 2 is horizontal, the remaining space or gap between the leveling ring 2 and the foundation 3 is filled with a grout material 5. The pressure acting on the grout layer when the wind turbine has been installed is effectively the downward force divided by the area of the leveling ring 2. With the leveling arrangement 1 according to the invention, use of a low-strength grout material 5 is sufficient, since the relatively wide leveling ring 2 provides a favorably large area.

Figure 5:
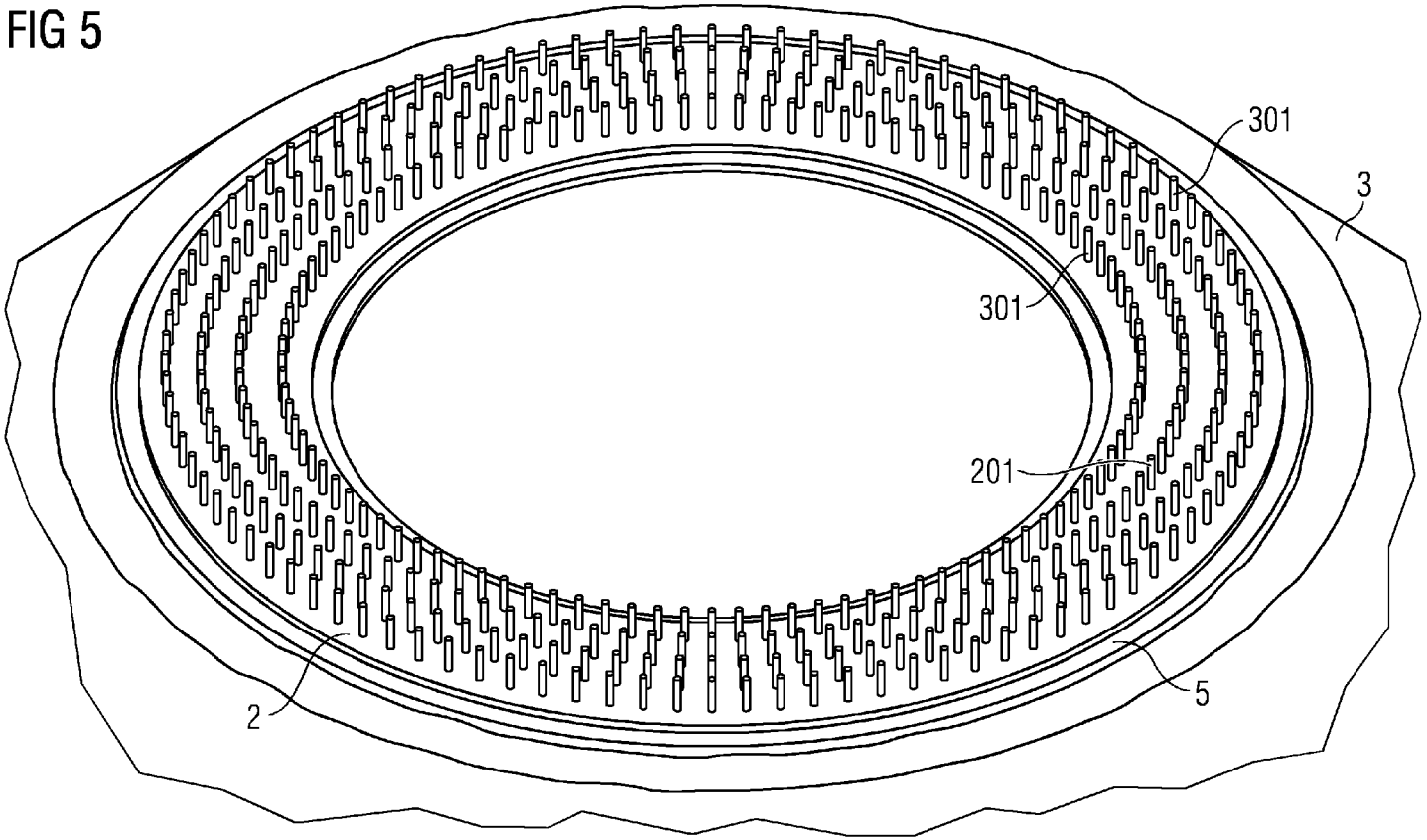
FIG. 5 shows level mounting interface obtained using the leveling arrangement according to the invention.

FIG. 5 shows a level mounting interface 2, 201 obtained using the leveling arrangement according to the invention. The leveling ring 2 has been bonded to the foundation by the anchor bolts 301 and securing nuts, and by the grout layer 5 between leveling ring 2 and foundation 3. After detaching and removing the leveling apparatus 10, the ring bolts 201 remain and extend vertically upward through the leveling ring 2. The diagram shows an embodiment in which two such annular formations of ring bolts 201 are ready for connection to a lower tower flange.

Figure 6:
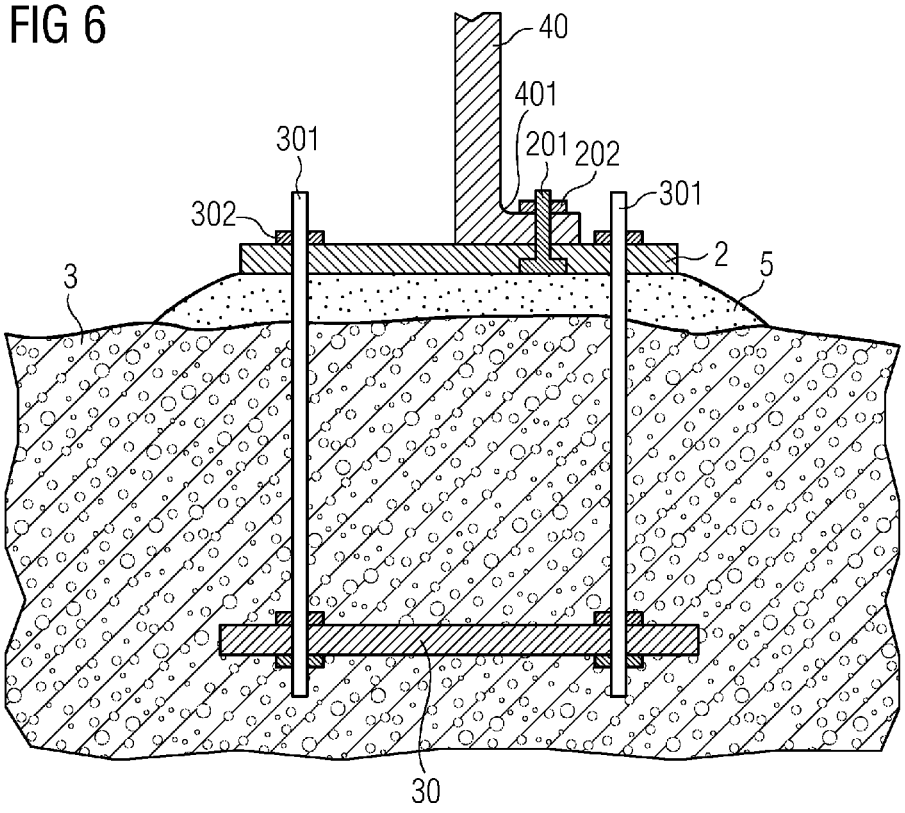
FIG. 6 is a schematic representation of a cross-section through a lower tower section and through a level mounting interface obtained using the leveling arrangement according to the invention.

FIG. 6 is a schematic representation of a cross-section through a lower tower section 40 and through a level mounting interface 2, 201 obtained using the leveling arrangement according to the invention. The diagram shows an anchor plate 30 embedded in a foundation 3 and holding a vertical arrangement of anchor bolts 301 that extend upward through the surface of the foundation 3. Using a leveling apparatus 10 as described above, and a single annular arrangement of ring bolts 201, a leveling ring 2 was lowered into place to accommodate the anchor bolts 301 and then aligned in a horizontal plane. A grout layer 5 was subsequently introduced between the foundation 3 and the leveling ring 2. The leveling ring 2 was then secured to the anchor bolts 301 by means of fasteners 302 such as hex nuts 302. After removing the leveling apparatus 10, a lower tower section 40 with outer flange 401 was lowered into place such that the ring bolts 201 passed through an annular arrangement of through-holes in the tower flange 401. The ring bolts 201 were then secured by fasteners such as hex nuts 202. This diagram also illustrates the possibility of designing the lower tower section 40 to have only one lower tower flange 401, in this case an outer flange 401. This is made possible by the favorable transfer of forces from the tower through the level mounting interface 2, 201 and into the foundation 3.

Figure 7:
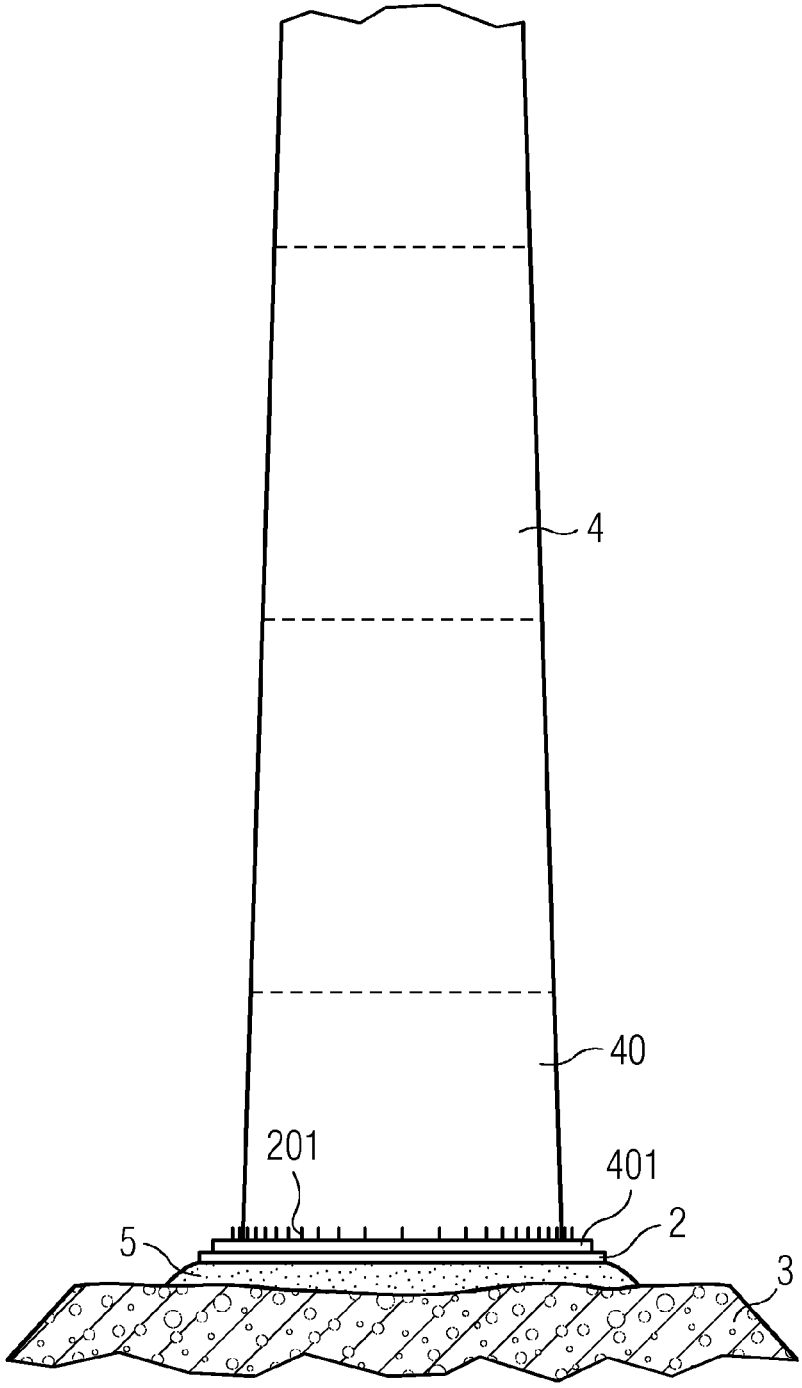
FIG. 7 shows a wind turbine tower assembly according to an embodiment of the invention.

FIG. 7 shows a wind turbine tower assembly 2, 3, 4 according to an embodiment of the invention. Here, the wind turbine tower 4 comprises several tower sections, and a lower tower section 40 is secured to a leveling ring 2 of a level mounting interface previously provided on a foundation 3. Any unevenness, i.e. any departure from the horizontal of the upper surface of the foundation 3 is corrected by the leveling ring 2 and a layer of grout 5, for example low-strength grout 5. A flange 401 of the lower tower section 40 is bolted to ring bolts 201 extending vertically upward through the leveling ring 2.

Although the present invention has been disclosed in the form of various embodiments and variations thereon, it will be understood that numerous additional modifications and variations could be made thereto without departing from the scope of the invention. For example, instead of separate anchor bolt rings and tower flange bolt rings, a bolt ring could comprise through-holes for anchor bolts alternating with through-holes for tower flange bolts. The leveling ring in this case could be connected to the cylindrical body with a tower bolt in every second through-hole, and lowered into place over the foundation such that each empty through-hole is lowered into place over an anchor bolt.

The invention claimed is:

1. A leveling arrangement for a tower, the leveling arrangement having a leveling ring configured to be placed between a tower foundation and the tower, and a leveling apparatus, the leveling apparatus comprising:

a connection means for detachably connecting the leveling apparatus to the leveling ring during a leveling procedure; and a plurality of adjustment legs, the plurality of adjustment legs being vertically extendable, wherein the plurality of adjustment legs are configured to effect a displacement of the leveling ring relative to the tower foundation during the leveling procedure by at least one of extending and retracting in a vertical direction.

2. A leveling arrangement according to claim 1, wherein the plurality of adjustment legs comprise a foot for resting on the foundation and a gripper for gripping the leveling apparatus.

3. A leveling arrangement according to claim 1, wherein the plurality of adjustment legs comprises three adjustment legs.

4. A leveling arrangement according to claim 1, wherein the plurality of adjustment legs include a height adjustment means for effecting the displacement of the leveling ring relative to the tower foundation.

5. A leveling arrangement according to claim 1, wherein the leveling apparatus comprises a cylindrical body, wherein the plurality of adjustment legs are connected directly to the cylindrical body by one or more gripper elements.

6. A leveling arrangement according to claim 1, wherein the connection means of the leveling apparatus for detachably connecting to the leveling ring comprises a flange with an annular arrangement of through-holes.

7. A leveling arrangement according to claim 6, wherein the annular arrangement of through-holes of the leveling ring corresponds to a tower flange annular through-hole arrangement.

8. A leveling arrangement according to claim 1, wherein the leveling ring comprises a plurality of leveling ring segments.

9. A leveling arrangement according to claim 1, comprising an offset detector for detecting an offset between an actual position of the leveling ring and a desired position of the leveling ring, wherein the offset detector communicates with a controller to actuate the plurality of adjustment legs.

10. A method of providing a level mounting interface for a tower, the method comprising:

detachably connecting a leveling ring to a leveling apparatus;

arranging the leveling apparatus over a tower foundation;

operating the leveling apparatus to vertically extend or retract at least one of a plurality of adjustment legs of the leveling apparatus to effect a displacement of the leveling ring relative to the tower foundation until the leveling ring presents an essentially level mounting surface;

bonding the leveling ring to the tower foundation; and disconnecting and removing the leveling apparatus from the leveling ring.

11. A method according to claim 10, wherein the step of arranging the leveling apparatus over the tower foundation comprises mating the leveling ring with a plurality of anchor bolt connectors protruding from the tower foundation.

12. A method according to claim 10, wherein the step of bonding the leveling ring to the tower foundation comprises filling any spaces between the leveling ring and the tower foundation with a grout layer.

13. A method according to claim 12, wherein the grout layer comprises a low strength grout material.

14. A method of erecting a wind turbine tower, the method comprising:

providing a level mounting interface for the wind turbine tower using the method according to claim 10, the level mounting interface comprising a leveling ring connected to a tower foundation and a plurality of connectors protruding through the leveling ring; and connecting a lower tower flange to the connectors of the level mounting interface.

* * * * *